United States Patent [19]

Linebaugh

[11] 4,075,780

[45] Feb. 28, 1978

[54] MARIONETTE ACTUATION

[76] Inventor: David T. Linebaugh, 7110 Sante Fe, Houston, Tex. 77061

[21] Appl. No.: 734,551

[22] Filed: Oct. 21, 1976

[51] Int. Cl.[2] ..... A63J 19/00; A63H 7/00

[52] U.S. Cl. ..... 46/13; 46/126

[58] Field of Search ..... 46/12, 13, 115, 126, 46/138, 139, 142, 159, 161

[56] References Cited

U.S. PATENT DOCUMENTS

| | | | |
|---|---|---|---|
| 3,024,551 | 3/1962 | Oppenheim | 46/126 |
| 3,178,852 | 4/1965 | Whitcomb | 46/126 |

FOREIGN PATENT DOCUMENTS

| | | | |
|---|---|---|---|
| 463,243 | 3/1937 | United Kingdom | 46/13 |

*Primary Examiner*—Louis G. Mancene

*Assistant Examiner*—Robert P. Swiatek

*Attorney, Agent, or Firm*—Wendell Coffee

[57] ABSTRACT

This marionette show unit is primarily intended for the operation by and entertainment of a child rather than for professional use.

Marionette assemblies include a marionette suspended from a suspension unit. The assembly may be placed in any one of four positions upon a stage. Any one of several marionette assemblies may be placed into the four positions on the stage. A keyboard on the stage moves strikers horizontally against the strings as they extend through the suspension unit so that the horizontal movement of the strings is translated into vertical movement of the strings, actuating the marionette in the conventional manner. Scenery at the back of the stage may be changed.

15 Claims, 4 Drawing Figures

10
12
16
20
22
24
26
28
30
31
32
34
36
38
40
42
44
46
48

Fig. 2
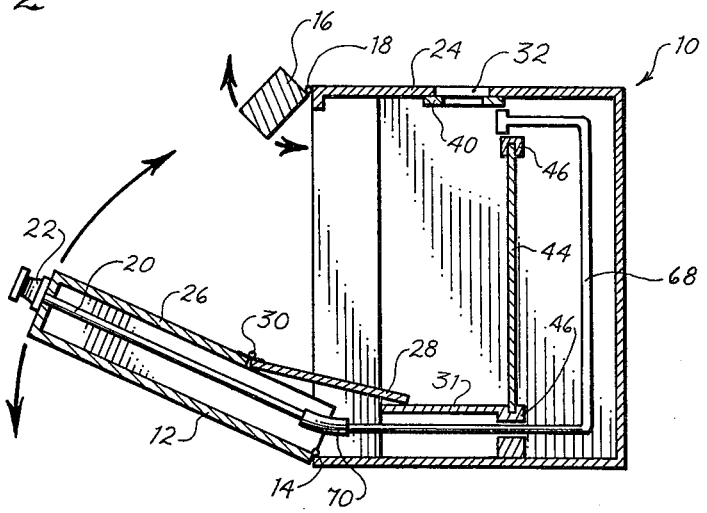
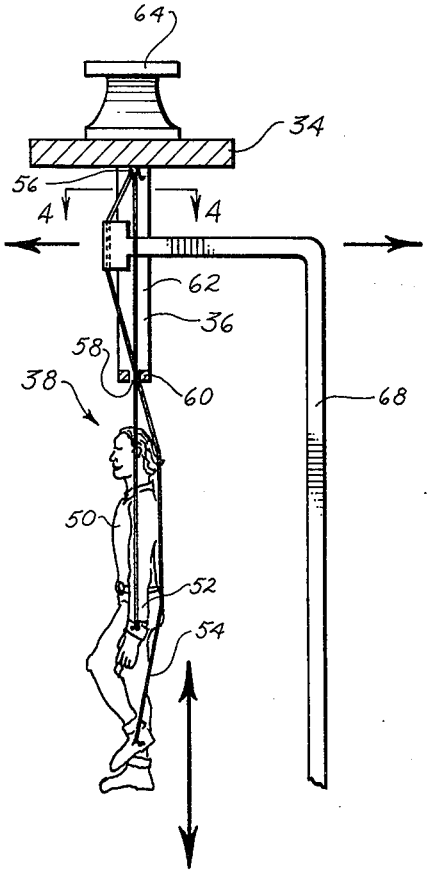
Fig. 3
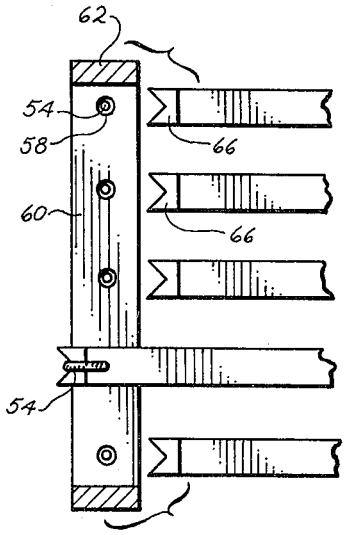
Fig. 4

MARIONETTE ACTUATION

BACKGROUND OF THE INVENTION

1. Field of the Invention

This invention relates to amusement devices and more particularly to a toy theater with marionettes.

2. Description of the Prior Art

Rogers, U.S. Pat. No. 1,820,367, discloses a toy marionette on a stage. The strings of the marionette are actuated by levers which are connected to a keyboard on the front of the stage. As the keys of the keyboard are depressed, the individual strings are raised. Rogers discloses a single marionette actuated by six keys.

Whitcomb, U.S. Pat. No. 2,570,737, discloses a single marionette the strings of which are led to a keyboard on the back. By pushing down the keys on the back, the marionette is operated. The patent discloses a single marionette with a single set of keys.

Whitcomb, U.S. Pat. No. 3,178,852, discloses a single marionette with room on a stage for only one. The stage structure appears to be mainly a box for storage. The marionette is suspended by lines or strings from a suspension unit and the suspension unit has mounted thereon a keyboard. The suspension is somewhat paddle-like. FIGS. 11 and 12 disclose the strings tied onto an element of the suspension unit and led through a hole in a flange-like portion of the suspension unit. The keys of the keyboard depress the string between the attachment and the apertured flange to be translated into vertical movement of the string. The marionette can be removed from the stage.

At the time of filing this application, applicant was also aware of Oppenheimer, U.S. Pat. No. 2,862,311, and Oppenheim, U.S. Pat. No. 3,024,551.

SUMMARY OF THE INVENTION

1. New and Different Function

I have invented a marionette actuation with four marionettes operated from a keyboard at the front of the stage. The marionettes are in self-contained assemblies hung from a suspension unit so that the marionettes can be moved from one position to another or the marionettes removed and another marionette placed in its position. I.e., for an example, there could be eight marionettes of which any four could be positioned on the stage at one time and any marionette removed and one of the others from "back stage" moved onto the stage.

This interchangability is possible because each of the suspension units has a top and a bottom plate spaced from one another with strings extending through holes in the bottom plate; therefore, lateral movement of the strings by strikers which are on the stage will actuate the marionette. The strikers are connected to the keyboard by a direct linkage.

Thus, I have achieved a new and different function—that of being able to have interchangeable marionettes operated from a front keyboard. In this regard, the combination of the individual parts is greater than the sum of their individual functions, i.e., a completely new and different function results.

2. Objects of this Invention

An object of this invention is to actuate a marionette.

Another object of this invention is to provide a plurality of marionettes on a stage which are operable from the front and which are readily interchangeable and which have readily interchangeable scenery.

Further objects are to achieve the above with a device that is sturdy, compact, durable, lightweight, simple, safe, efficient, versatile, and reliable, yet inexpensive and easy to manufacture, install, adjust, operate, and maintain.

Other objects are to achieve the above with a method that is versatile, rapid, efficient, and inexpensive, and does not require skilled people to interchange, adjust, operate, and maintain.

The specific nature of the invention, as well as other objects, uses, and advantages thereof, will clearly appear from the following description and from the accompanying drawing, the different views of which are not to the same scale.

BRIEF DESCRIPTION OF THE DRAWING

FIG. 2 is a sectional view of the stage in a partially folded position with the backdrop in position with the marionette assembly removed.

FIG. 3 is a sectional view of the marionette assembly with the suspension unit shown in section and with a striker from the stage actuating one string.

FIG. 4 is a sectional view taken substantially on line 4—4 of FIG. 3 showing the strikers on the stage and the suspension unit.

E. DESCRIPTION OF THE PREFERRED EMBODIMENT

Figure 1:
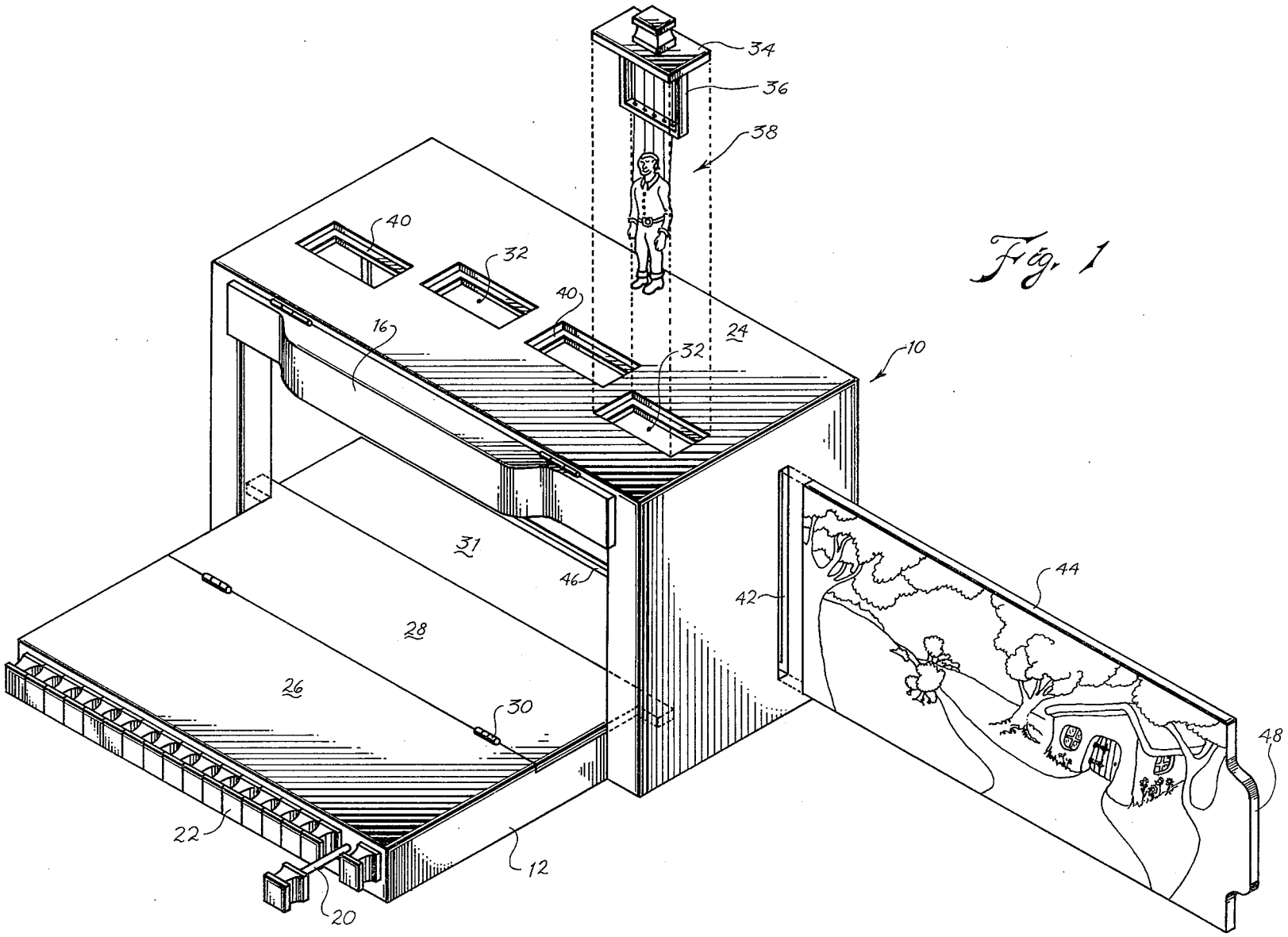
FIG. 1 is a perspective view of the stage unfolded with a backdrop scene withdrawn from a stage and with a marionette assembly withdrawn from its pocket.

Referring to FIGS. 1 and 2, there may be seen represented stage 10. The stage is basically box shaped and has front cover 12 folded at hinges 14 at the front bottom. There is a hinged top cover or arch 16. The top cover 16 is folded by hinges 18 at the top front. The bottom cover 12 is hollowed out so pitmans 20 may extend therethrough. Keys or knobs 22 are on the end of the pitmans 20 at the front of the cover 12. When the main cover 12 is folded up, the keys 22 are immediately below top 24 of the stage 10. The top cover 16 must be folded up before the main cover 12 will fold up and then after the main cover 12 is in the closed position, the top cover 16 may be folded down in the closed position to protect the keys 22 and to hold the cover 12 in the closed position.

Forestage floor 26 is on the inside of the cover 12 when it is folded in or on the top of the cover when it is folded out. The pitmans 20 are below the forestage floor 26. Middlestage floor 28 is hinged to the forestage floor 26 by hinges 30. Backstage floor 31 is built into the stage 10 as shown.

Referring to FIG. 1, it may be seen that when the stage is open the three stage floors form a floor appearance for the stage. When the cover 12 is folded up, (FIG. 2), the middlestage folds at the hinge 30 so that the cover 12 will be flush with the front of the box or stage 10.

The top 24 of the stage contains four pockets or openings 32. These are made to receive top plate 34 of suspension unit 36 of marionette assembly 38. Each pocket has ledge 40 on the inside so the top plate 34 will rest flush with the top 24 of the stage.

The stage has slot 42 on one side thereof so backdrop panel 44 may be inserted. As may be seen in FIG. 2, the inside of the stage or box 10 is provided with channels or tracks 46 to receive the backdrop panel 44. As may be seen, the backdrop panel 44 has scenery painted thereon so it forms the scenery of the stage. The backdrop panel 44 has tab 48 which will protrude from the slot 42 so it may be grasped for changing the scenery upon the stage. Although only one backdrop 44 is shown, it will be understood that a plurality of backdrops provide the scenery upon the stage to be changed.

Likewise, only the one marionette assembly 38 has been shown in FIGS. 1 and 3, but it will be understood, of course, that any number are used. Indeed, it is contemplated that the stage with four marionette assemblies would be sold as a starter package and then additional marionette assemblies 38 could be sold separately. A child could perhaps begin with a single backdrop and four marionette assemblies, which could be placed in any one of the four pockets 32. Thereafter, as additional holidays occurred, the child could purchase or be given additional marionette assemblies 38 and additional backdrop panels 44 so he could accumulate a great number of marionette assemblies and backdrop panels. These could be sold in units. E.g., four pastorial marionettes with a backdrop assembly could be sold or four Parisian marionettes with a backdrop panel showing a scene in Paris, or four martial marionettes with a battlefield backdrp could be sold. Then, there are the fairy tales. E.g., the three little pigs and the wolf with a forest backdrop panel, or Cinderella with a pumpkin backdrop. The possibilities are as numerous as childhood holidays.

The marionette assembly 38 includes marionette 50. The marionette is conventional and has various moving parts or limbs 52. There are a plurality of strings 54 and one string is attached to each movable limb. This is conventional. When the strings are pulled or displaced vertically the limb moves, giving apparent life to the marionette. The design of marionettes with their strings is an old and well known art. The strings extend up to eye screws 56 or the like in the bottom of the top plate 34 and are attached there.

The strings 54 are each led through one of a plurality of holes 58 in bottom plate 60. The bottom plate 60 is attached by strut 62 to the top plate so it is below the top plate and spaced therefrom. The top plate has knob 64 theron. The top plate 34 with its knob 64 and the apertured bottom plate 60 with the connecting strut forms the suspension unit 36. The suspension unit with the strings 54 and the marionette 50 form the marionette assembly.

It may be readily seen that when the strings 54, between the top and bottom plate, are laterally or horizontally displaced, this is translated by holes 58 into vertical movement upon the strings. Therefore, it may be seen that the strings between the top and bottom plate form raising means of the suspension unit for individually raising the strings. Therefore, if notched strikers 66 are moved against the strings they will actuate the marionette. The strikers 66 are attached to "C" shaped member 68 (FIGS. 2 and 3). The "C" shaped member 68 is connected by flexible tubing 70 to the pitman 20. The flexible tubing is immediately above the hinge 14.

Therefore, it may be seen that when any of the individual keys 22 are pulled, this will move the "C" shaped member forward which will move the striker 66 forward against the raising means at the suspension unit, thus, actuating the marionette. Also, of course, it will be understood that the striking units must be spaced back of the pockets 32 so that the marionette assemblies may be inserted and removed without interference. It is also seen that it is not necessary to have the pockets 32 in line, but they can be staggered, provided, of course, the "C" shaped members 68 are so positioned that the strikers 66 are within access of the raising means which is the strings 54 between the top and bottom plates of the suspension units.

Thus, it may be seen that I have provided a simple unit. Those skilled in the art will readily understand that other types of actions could be made between the keys on the keyboard and the raising means and other types of raising means could be used. However, to have the interchangeable parts, it is necessary according to my invention to have the raising unit on the marionette assembly and the striker on the stage within the stage box.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | stage | 42 | slot |
| 12 | cover | 44 | panel, backdrop |
| 14 | hinges | 46 | track |
| 16 | top cover | 48 | tab |
| 18 | top hinges | 50 | marionette |
| 20 | pitman | 52 | limb |
| 22 | keys | 54 | string |
| 24 | top | 56 | eye screw |
| 26 | forestage floor | 58 | hole |
| 28 | middle stage floor | 60 | bottom plate |
| 30 | hinges | 62 | strut |
| 31 | backstage floor | | |
| 32 | pockets | 64 | knob |
| 34 | top plate | 66 | striker |
| 36 | suspension unit | 68 | "C" member |
| 38 | marionette assembly | 70 | tubing |
| 40 | ledge | | |

I claim as my invention:

1. The method of actuating marionettes on a stage, each marionette having a. movable parts with b. a plurality of strings, one string attached to each of the movable parts, comprising the steps of:

c. suspending each of the marionettes from a suspension unit, d. inserting one of the suspension units into the stage, e. manipulating individual keys on a keyboard on the stage, thus individually f. raising the strings below the suspension unit responsive to the manipulation by g. moving a striker mounted on the stage from a first position which is clear of the suspension unit to a second position against a part of the suspension unit to raise a string on the suspension unit, and h. removing and replacing one of the suspension units, thus changing a marionette.

2. The invention as defined in claim 1 with an additional limitation of j. changing scenery on the stage behind the marionettes.

3. In a marionette assembly adapted to be placed into a stage of same, said assembly having
a. a marionette with movable parts,
b. a plurality of strings, one string attached to each of the movable parts;
the improved structure for holding the strings to be manipulated comprising:
c. a top plate to which the strings are attached and
d. a bottom plate
(i) attached to the top plate,
(ii) spaced below the top plate and
(iii) having a plurality of holes spaced therethrough,
e. said top and bottom plates forming a suspension unit,
f. each of said strings extending through one of the holes so that lateral displacement of the string will be translated into vertical displacement of the string below the bottom plate, thereby actuating the moving parts of the marionette.

4. The invention as defined in claim 3 with additional limitations of
g. a stage with
h. the suspension unit mounted thereon and the marionette suspended on the stage, and
j. means on the stage for individually displacing the strings between the top and bottom plate.

5. The invention as defined in claim 4 with an additional limitation of
k. more than one marionette assembly as defined on a single stage.

6. The invention as defined in claim 5 with additional limitations of
m. said stage being enclosed in a box,
n. a slot in the side of the box,
o. backdrop scenery painted on a panel,
p. said panel inserted onto the stage through said slot.

7. In a marionette show unit having
a. a marionette assembly including a marionette with
(i) movable parts, and
(ii) a plurality of strings, one string attached to each of the movable parts, and
b. a stage for the marionette with
the improved structure for manipulating the strings comprising:
c. the marionette assembly also including a suspension unit for the marionette, said strings attached to
d. a raising means on the suspension unit for individually raising the strings,
e. said suspension unit removably mounted in the stage,
f. a plurality of strikers on the stage with one striker for operating each of the raising means,
g. a keyboard on the stage with a key for each string on the marionette, and
h. a linkage connecting each key with each striker so that operation of a key will manipulate a part of the marionette by the striker operating the raising means.

8. The invention as defined in claim 7 with additional limitations of
j. said stage being enclosed in a box,
k. a slot in the side of the box,
m. backdrop scenery painted on a panel,
n. said panel inserted onto the stage through said slot.

9. The invention as defined in claim 7 with additional limitations of
j. the stage having a cover hinged to the bottom of the stage
k. so that when the cover is open the cover forms a forestage floor.

10. The invention as defined in claim 9 with an additional limitation of
m. said keyboard mounted on said cover.

11. The inention as defined in claim 7 with an additional limitation of
j. more than one marionette assembly as defined on a single stage.

12. The invention as defined in claim 11 with additional limitations of
k. the stage having a cover hinged to the bottom of the stage
m. so that when the cover is open the cover forms a forestage floor.

13. The invention as defined in claim 12 with an additional limitation of
n. said keyboard mounted on said cover.

14. The invention as defined in claim 13 with additional limitations of
o. said stage being enclosed in a box,
p. a slot in the side of the box,
q. backdrop scenery painted on a panel,
r. said panel inserted onto the stage through said slot.

15. The invention as defined in claim 14 wherein said raising means includes:
s. a top plate to which the strings are attached, and
t. a bottom plate
(i) attached to the top plate,
(ii) spaced below the top plate, and
(iii) having a plurality of holes placed therethrough,
u. each of said strings extending through one of the holes so that
v. a lateral displacement by said striker will be translated into vertical displacement of the string below the bottom plate, thereby activating the moving parts of the marionette.

* * * * *